United States Patent [19]

Yu

[11] Patent Number: 5,049,511

[45] Date of Patent: Sep. 17, 1991

[54] RESILIENT CONNECTOR CAPABLE OF BEING INSERTED INTO A PRINTED CIRCUIT BOARD

[75] Inventor: Mu-Gen Yu, Tansui Chen, Taiwan

[73] Assignee: Silitek Corporation, Taipei, Taiwan

[21] Appl. No.: 515,780

[22] Filed: Apr. 26, 1990

Related U.S. Application Data

[63] Continuation of Ser. No. 312,221, Feb. 21, 1989, abandoned.

[51] Int. Cl.[5] ..... H01R 13/62

[52] U.S. Cl. ..... 439/325; 439/856; 439/636

[58] Field of Search ..... 439/325–328, 439/629–637, 55, 59, 62, 60, 61, 856, 857, 861, 862

[56] References Cited

U.S. PATENT DOCUMENTS

| | | | |
|---|---|---|---|
| 3,848,952 | 11/1974 | Tighe, Jr. | 439/326 |
| 3,993,383 | 11/1976 | Marino | 439/59 |
| 4,136,917 | 1/1979 | Then et al. | 439/326 |
| 4,367,006 | 1/1983 | Rehbogen et al. | 439/636 |
| 4,576,427 | 3/1986 | Verbruggen | 439/636 |
| 4,713,013 | 12/1987 | Regnier et al. | 439/326 |
| 4,756,694 | 7/1988 | Billman et al. | 439/328 |

*Primary Examiner*—David L. Pirlot

*Attorney, Agent, or Firm*—Lowe, Price, LeBlanc & Becker

[57] ABSTRACT

A resilient connector capable of being inserted into a printed circuit board comprises a clamp head portion and a leg portion. Moreover, the clamp portion has a long arm, a short arm and a base connected between the long arm and the short arm. The leg portion is formed by longitudinally severing a part of the intermediate portion of the clamp head portion, which extends from an intermediate position of the long arm to an intermediate position of the base. Thus, the printed circuit board can be inserted into, and brought into contact with, the contact surface of the clamp head portion. Subsequently, the printed circuit board may be pivoted to a second angular position from a first angular position. Preferably, the second angle is selectively designed at a 25 degrees orientation to assure the conservation of space.

4 Claims, 3 Drawing Sheets

RESILIENT CONNECTOR CAPABLE OF BEING INSERTED INTO A PRINTED CIRCUIT BOARD

This application is a continuation of application Ser. No. 07/312,221 filed Feb. 21, 1989, now abandoned.

BACKGROUND OF THE INVENTION

The present invention relates to a resilient connector, more particularly to a resilient connector capable of being inserted into a computer's printed circuit board.

Conventionally, an interface card is usually employed in an electrical connector of computer device and inserted into a receptacle therewith, especially when the user requires an additional function to achieve some special purpose. Thus, the purpose of the electrical connector is mainly to transfer the electrical connection between the computer device and the interface so as to perform a particular function. Referring to FIG. 1, a sectional view of a known electrical connector, including a leg portion 90 and a clamp portion 91, is provided. The leg portion 90 is inserted into a hole of a slot 93 within a receptacle 92. The clamp portion 91 with an opening 94 is accommodated within the slot 93 so as to hold the printed circuit board through said opening 94. In addition, the printed circuit board offers a pair of contact pads 96 at the front end thereof for making contact with the contact surfaces at the free end of the clamp portion 90 when the printed circuit board is inserted into said opening 94. Subsequently, the printed circuit board is pivoted to a second angular position from a first angular position for accomplishing the operation by applying a stress in a certain orientation.

Although the aforesaid known connectors may achieve special function and purpose by the electrical connection. The following drawbacks still remain:

Firstly, the shape of said connector is cut along an imaginary line from a copper plate as designated in FIG. 2. As shown in the drawing, it is found that the remaining copper plate portion, (represented by a sloped line), will be disposed of, causing a waste of material. Secondly, the contact pads 96 on the printed circuit board are usually scratched or damaged due to the abnormal contact between both said contact pads 96 and the contact surfaces of the clamp portion 91.

SUMMARY OF THE INVENTION

An object of this invention is to provide a resilient connector which may be inserted into a printed circuit board in one angular position and pivoted to another angular position so as to achieve electrical connection.

Another object of this invention is to provide a resilient connector which can be made by using the most economical material.

A further object of this invention is to provide a resilient connector which may prevent the printed circuit board from being scratched or damaged.

According to this invention, a resilient connector with an opening for accommodating a printed circuit board therethrough, which comprises a rectangular head portion with a flat surface bent into a U-shape so as to form a long arm, a short arm and a base connected between said long arm and said short arm, each arm extending upwardly and separately from one end of the base. The long arm also has one free end adapted to be bent into a predetermined curve thereby providing a first contact surface. The short arm also has a free end adapted to be bent into another predetermined curve thereby providing a second contact surface which faces the first contact surface of the long arm in a certain orientation so as to define the opening adapted to the insertion of the printed circuit board; and a leg portion integrally and downwardly extending from an intermediate position of the base for supporting the same, the leg portion being formed by longitudinally severing a part of the intermediate portion of the rectangular head portion, which extends from an intermediate position of the long arm to the intermediate position of the base, and bending the severed portion downward at the intermediate position of the base.

whereby the printed circuit board can be inserted into, and brought into contact with, the contact surfaces through the opening at a first angle, and be pivotally rotated to, and fixed at, a second angle.

These and other features and advantages of the present invention will be apparent from the following detailed description in conjunction with accompanying drawings, in which :

DETAILED DESCRIPTION OF THE PREFERRED EMBODIMENT

Figure 1:
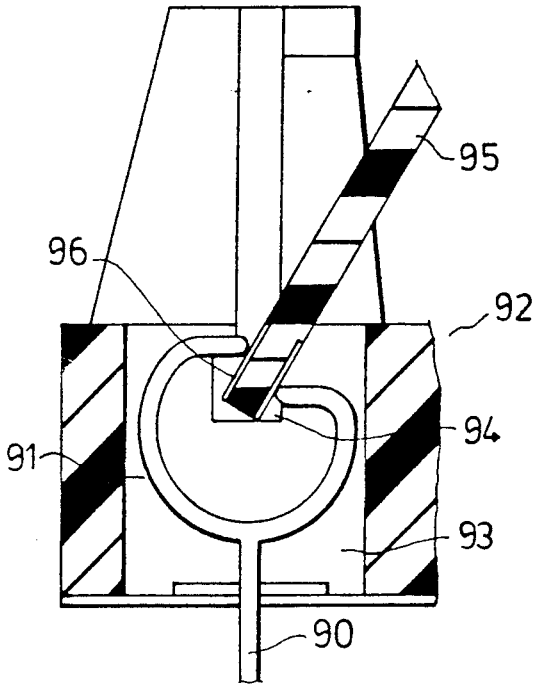
FIG. 1 is a sectional view of a known electrical connector.
Figure 2:
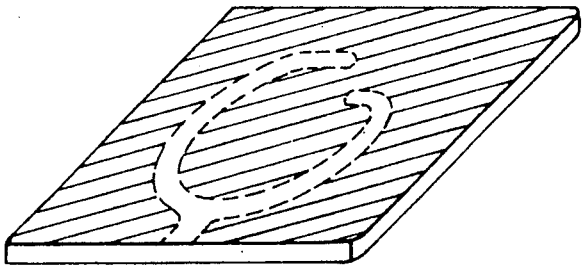
FIG. 2 is a schematic view of a known copper plate showing the connector which is cut depending on the field of the imaginary line.
Figure 3:
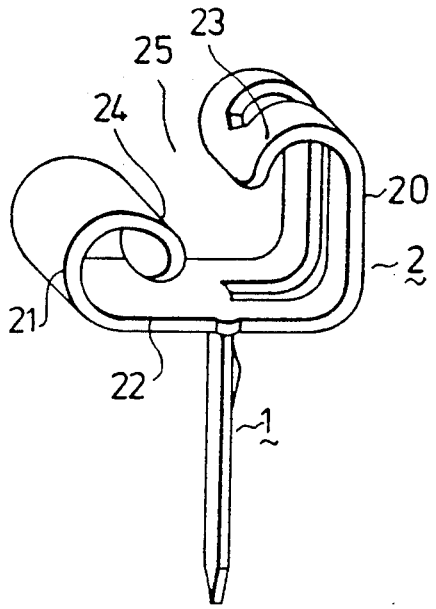
FIG. 3 is a perspective view of a resilient connector according to the invention.

Referring to FIG. 3, a resilient connector having a clamp head portion 2 and a leg portion 1 is provided. It should be noted that the clamp head portion 2 is bent into a desired shape by utilizing a rectangular copper plate. The resilient connector is formed by a long arm 20, a short arm 21 and a base 22, connected between the long arm 20 and the short arm 21. The long arm 20 and the short arm 21 extend upward, separately from one end of the base 22. In addition, the long arm 20 has one free end adapted to be bent inward to a predetermined curve so as to creating a first contact surface 23. The short arm 21 also has a free end adapted to be inwardly bent into another predetermined curve so as to create a second contact surface 24 which faces the first contact surface 23 of the long arm 21 in a certain orientation so as to define an opening 25 adapted to the insertion of a printed circuit board 8 (see FIG. 4). It should be appreciated that the magnitude of the curvature of the long arm 20 is lesser than that of the short arm 21 so as to facilitate the pivoting of the printed circuit board 8 to another angular position.

In addition, the leg portion 1 integrally and downwardly extends from an intermediate position of the base 22 for supporting the same. The leg portion 1 is created by longitudinally severing a part of the intermediate portion of the rectangular head portion 2, which extends from an intermediate position of the long arm 20 to the intermediate position of the base 22, and bending the severed portion downward at the intermediate position of the base 22.

Figure 4:
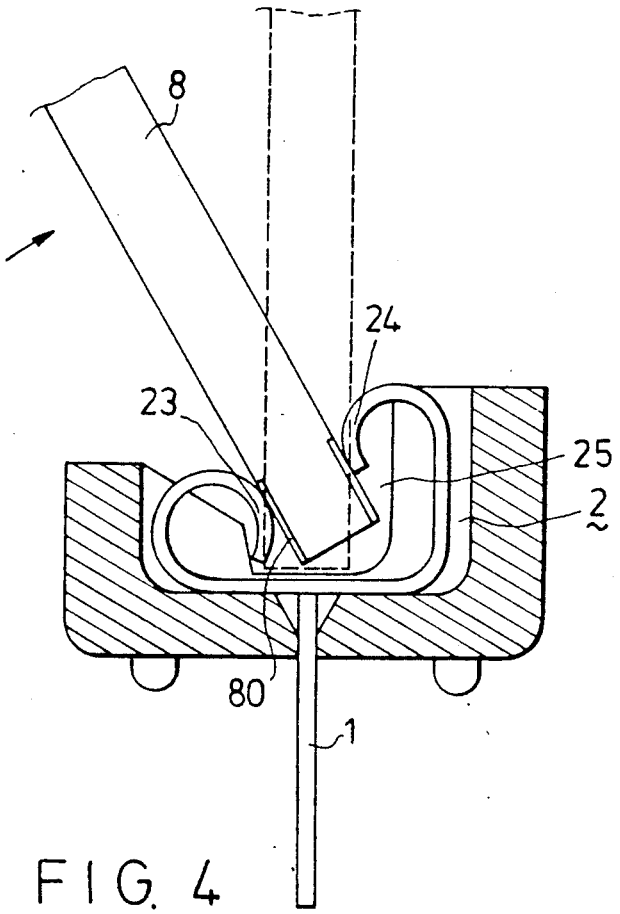
FIG. 4 is a sectional view of a resilient connector showing the printed circuit board pivoted to a vertical position from another position.

Referring now to FIG. 4, the resilient connector is mounted within a receptacle. The printed circuit board 8 can be inserted into, and brought into contact with, the contact surfaces 23, 24 by a pair of contact pads 80 through the opening 25 at a first angle, (as indicated by the solid line), and then be pivotally rotated to, and fixed at, a second angle, (as indicated by the imaginary line), for achieving an electrical connection. Moreover, the second angle, according to this invention, is designed to be at 90 degrees relative to the base surface. Due to the flat design of the contact surfaces of the invention, the scratching and damage common in the prior art may be prevented from occurring. It should be noted that the printed circuit board 8 is tightly clamped by said contact surfaces 23, 24, when it is pivoted to the second angular position from the first angular position.

Figure 5:
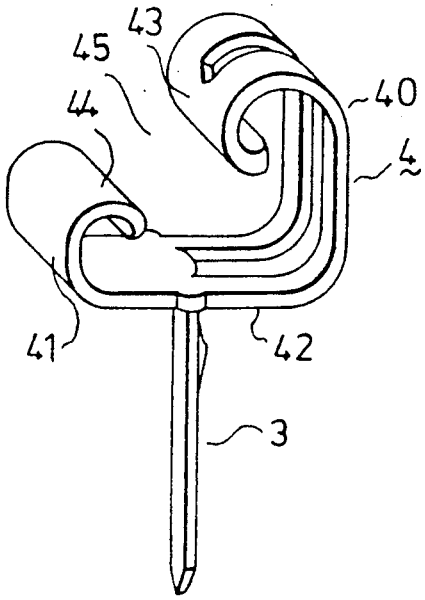
FIG. 5 is a perspective view of another embodiment of a resilient connector of FIG. 3.

Referring also to FIG. 5, a resilient connector of another embodiment of the invention is illustrated. Likewise, the resilient connector also has a clamp head portion 4 including a long arm 40, a short arm 41 and a leg portion 3. The resilient connector of the drawing is similar to that shown in FIG. 4. Obviously, the difference between said resilient connectors, resides in the magnitude of the curvature of the free ends of said arms. In other words, the curvature of the long arm 40 is greater than that of the short arm 41 so as to facilitate the pivoting of the printed circuit board 8 to another angular position.

Figure 6:
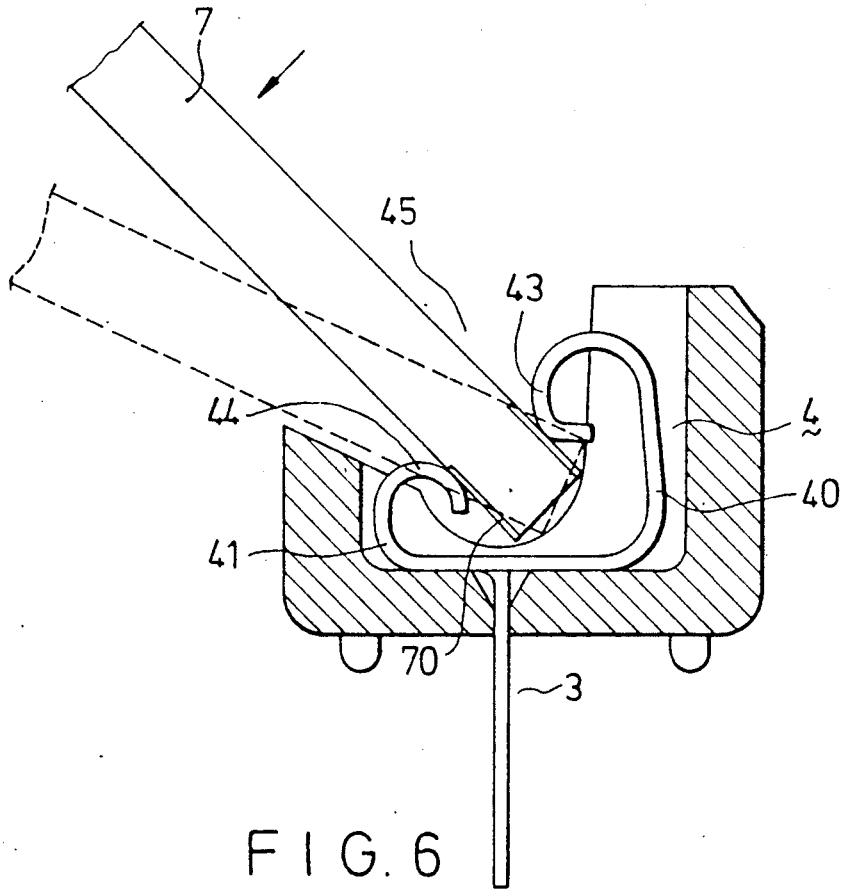
FIG. 6 is a sectional view of a resilient connector of FIG. 5 showing the printed circuit board is pivoted to 25 degrees from another position.

Referring to FIG. 6, the resilient connector is disposed within a receptacle. As shown in the drawing, the printed circuit board 7 can be inserted into, and brought into contact with, the contact pads 70 of the free ends of the clamp head portion 4 through the opening 45. Subsequently, the printed circuit board 7 is pivoted to a second angular position from the first angular position by the clamping force of said contact surfaces 43, 44. Also, the second angular position is designed to be at 25 degrees relative to the base surface. The advantage of the design is that it may offer the alternative of a different angular disposition together with the conservation of space.

With the invention thus explained, if is apparent that many modifications and variations can be made without departing from the scope of the invention. It is therefore intended that the invention only be limited as indicated in the appended claims.

I claim:

1. A resilient connector formed from a single conductive, rectangular plate having opposed contact surfaces defining an opening for accommodating a printed circuit board having contact pads on either side for contacting said surfaces therethrough, comprising:

means for receiving a printed circuit board between said contact surfaces and for maintaining continuous contact between said surfaces and pads thereon as said board enters said opening at a first angle and is pivotally rotated to and fixed at a second angle without scratching said pads said means comprising;

said plate being bent into a U-shape so as to form a long arm, a short arm and a base connected between said long arm and said short arm, each arm extending upwardly and separately from one end of said base, said long arm having one free end bent into a curve having a first predetermined radius and facing said short arm thereby providing a first contact surface, said short arm having a free end bent into a curve having a second predetermined radius different from the first radius and facing said long arm thereby providing a second contact surface said contact surfaces being oriented so as to define said opening for the insertion of said printed circuit board at an acute angle to the base with the contact surfaces riding against the conductive pads and further riding against said pads as the board rotates to a fixed position extending at a 90° angle to the base; and a leg portion integrally and downwardly extending from an intermediate position of said base for supporting the same, said leg portion being formed by longitudinally severing a part of the intermediate portion of said rectangular head portion, which extends from an intermediate position of said long arm to said intermediate position of said base, and bending the severed portion downwardly at said intermediate position of said base.

2. A resilient connector as claimed in claim 1, wherein the magnitude of said curvature of said long arm is lesser than that of said short arm so as to facilitate the pivoting of the printed circuit board to another angular position.

3. A resilient connector as claimed in claim 1, wherein the magnitude of said curvature of said long arm is greater than that of said short arm so as to facilitate the pivoting of the printed circuit board to another angular position.

4. A resilient connector as claimed in claim 3, wherein said second angle position is designed to be at 25 degrees relative to said base.

* * * * *